US007504025B2

(12) United States Patent
Burgassi

(10) Patent No.: US 7,504,025 B2
(45) Date of Patent: Mar. 17, 2009

(54) SELF-PROPELLED FLOATING DEVICE FOR CLEANING WATER SURFACES

(75) Inventor: Rinaldo Burgassi, Lorenzana (IT)

(73) Assignee: Watertech S.r.l., Calcinaia PI (IT)

( * ) Notice: Subject to any disclaimer, the term of this patent is extended or adjusted under 35 U.S.C. 154(b) by 0 days.

(21) Appl. No.: 10/532,420

(22) PCT Filed: Oct. 22, 2003

(86) PCT No.: PCT/IB03/04670

§ 371 (c)(1),
(2), (4) Date: Oct. 17, 2005

(87) PCT Pub. No.: WO2004/038131

PCT Pub. Date: May 6, 2004

(65) Prior Publication Data

US 2006/0096905 A1 May 11, 2006

(30) Foreign Application Priority Data

Oct. 22, 2002 (IT) ..... PI2002A0060

(51) Int. Cl.
*E04H 4/16* (2006.01)

(52) U.S. Cl. ..... 210/122; 210/167.2; 210/170.05; 210/242.1; 4/490

(58) Field of Classification Search ..... 210/167.19, 210/167.2, 170.05, 122, 242.1, 167.1; 4/490, 4/496

See application file for complete search history.

(56) References Cited

U.S. PATENT DOCUMENTS 3,718,148 A * 2/1973 Gibellina ..... 4/490
3,767,055 A * 10/1973 Flatland ..... 210/242.1
4,105,557 A * 8/1978 Weatherholt ..... 210/167.2
4,129,904 A * 12/1978 Pansini ..... 4/490
4,746,424 A * 5/1988 Drew ..... 210/167.2
5,106,492 A * 4/1992 Distinti et al. ..... 210/242.1
5,128,031 A * 7/1992 Midkiff ..... 210/167.2
5,788,850 A * 8/1998 Tuomey ..... 210/167.2
6,432,304 B1 * 8/2002 Nguyen ..... 210/242.1

FOREIGN PATENT DOCUMENTS

EP 0936328 A 8/1999
FR 2796576 A 1/2001
WO WO9109193 A 6/1991

* cited by examiner

*Primary Examiner*—Christopher Upton
(74) *Attorney, Agent, or Firm*—Jason A. Bernstein; Bryan Cave LLP

(57) ABSTRACT

A floating self-propelled cleaning device (10) for water surfaces, in particular swimming pools, comprises a central floating body (11) and two side floating elements (12) to it connected at opposite sides by two arms (14) to which two net-shaped collecting containers (13) are fastened. The net-shaped containers (13) have openings (17) that allow the inlet of impurities, but prevent the outlet thereof during possible stops or under the action of waves that can occur during the travel on the water surface. The floating device (10) is driven by propelling means (20) and (30) that substantially cause the side floating elements (12) to rotate about an instantaneous centre of rotation located approximately at the central body (11). The rotation of the side floating elements (12) is associated to a shifting movement caused by at least a distribution element (15) movable with respect to the floating body (10). The sum of these two effects provides a resulting trajectory of the device (10) that causes the net-shaped containers (13) to sweep the whole water surface.

11 Claims, 5 Drawing Sheets

SELF-PROPELLED FLOATING DEVICE FOR CLEANING WATER SURFACES

PRIORITY CLAIM

This application claims the priority to International Patent Application PCT/IB03/004670 filed Oct. 22, 2003 which claims priority to Italian Patent Application ITPI2002A000060 filed Oct. 22, 2002. The disclosure of this application is incorporated by reference in its entirety herein.

FIELD OF THE INVENTION

The present invention relates to a floating self-propelled cleaning device for removal of impurities, as leaves or insects, from the water surface of swimming pools, fountains, etc.

BACKGROUND

As known, outdoor swimming pools are often made dirty by leaves, powder, insects that fall on the water surface. As a rule, they are periodically manually cleaned at the surface level by a pole with a net.

Furthermore, swimming pools normally comprise a filtration and recirculation system that has the task of intaking the water, filtering it and pumping it depurated and disinfected again in the pool.

These systems, diagrammatically shown in FIGS. 1 and 2, normally comprise "skimmers". Each skimmer comprises an opening 2 in the wall 3 of the pool, for the water intake at the surface level, a removable basket 4, located inside, for keeping the largest floating impurities before that the water reaches one or more filters.

Even if they are cheap and effective, the skimmers are often insufficient, since the water surface movement is slow and is subject to the wind influence that causes the dirt to gather in certain zones of the swimming pool not covered by the skimmers action, and then requiring to remove it manually.

Possible water jets towards the bottom and the sidewalls of the swimming pool can affect the operation of a skimmer, also. Such jets, in fact, create turbulence in the pool that affects the surface flow towards the skimmer.

Systems are also known comprising a net connected to a support capable of sliding on the edges of the swimming pool. Such systems are bulky and have the further drawback of requiring the presence of an operator.

Furthermore, floating self-propelled devices exist comprising a collecting container and a propelling system. However, such devices are not much efficient, since they have a purely translational movement that does not allow covering the whole surface of the swimming pool. Furthermore, it is necessary to control and shift them when they meet an obstacle along their path.

SUMMARY OF THE INVENTION

It is therefore a feature of the present invention to provide a floating cleaning device for water surfaces capable of removing from the water surface the impurities, such as leaves and insects, which has not the above-described drawbacks.

It is another a feature of the present invention to provide such a device structurally easy and not expensive.

These and other features are accomplished by the floating self-propelled cleaning device for water surfaces, of the present invention. In one exemplary embodiment the present invention comprises a learning device comprising a floating body; at least one net-shaped collecting container connected to the floating body and having an inlet; means for causing said floating body to rotate so that the inlet of said container sweeps a portion of the water surface; and means for causing a shifting movement to said floating body that serves, together with said rotation, to move the floating body and cover all the water surface; and at least one energy source for the means for causing a rotation to the floating body.

Preferably, the means for causing a rotation to the floating body comprises at least one jet means suitable for generating a thrust that causes the rotation of the floating body about an instantaneous centre of rotation.

Advantageously, the floating body comprises a central body and two side floating elements connected to the central body from opposite sides. The means for causing a rotation comprise two water jets forming a propelling couple with respect to a centre of rotation.

Advantageously, the means for causing a shifting movement comprise at least a distribution element movable with respect to the floating body suitable for operating said or each propelling means for generating intermittent thrusts.

Preferably, said means for causing a rotation to the floating body comprises a first and a second propelling means arranged at said side floating elements and opposite to each other.

Alternatively, the propelling means is in a position distanced from the centre of rotation.

Advantageously, the distribution element comprises a blade dipped in water associated to a distribution element selecting alternatively each propelling means. This allows alternating the two forward thrusts for causing the rotation of the floating body together with a shifting component for assuring to sweep the entire water surface.

The distribution element can be a cam disk, fixed with respect to a reference system that is external to the cleaning device. In particular, the cam disk has a first portion with a larger outer diameter and a second portion with a lower outer diameter and is located at two switches associated to the two propulsion jets. Therefore, the cam disk, during the rotation of the cleaning device operates only the propulsion jets whose switch is momentarily located at the portion with higher diameter and closes the electrical circuit of that branch leaving open the other branch.

A further exemplary embodiment of the present invention provides that the energy distribution means comprises a two-way valve arranged in a central chamber of a deflecting element that directs alternatively a water flow, to two outlets having apertures oriented in opposite directions, in order to generate a thrust in a corresponding direction.

Advantageously, at least one feeler pawl is provided suitable for blocking the delivery of energy to the corresponding propelling means when the device meets an obstacle. This way, the self-propelled cleaning device is capable to pass the obstacle, for example, a sidewall of the pool, substantially bouncing off the obstacle same and then starting again to sweep the water surface according to a different trajectory.

Preferably, the energy for driving the floating device is supplied by at least one solar panel, arranged between the side floating elements and the central body. The panel can be associated to a storage battery.

BRIEF DESCRIPTION OF THE DRAWINGS

The invention will now be illustrated with the following description of an exemplary embodiment thereof, exemplifying but not limitative, with reference to the attached drawings wherein.

DETAILED DESCRIPTION OF THE INVENTION

Figure 1:
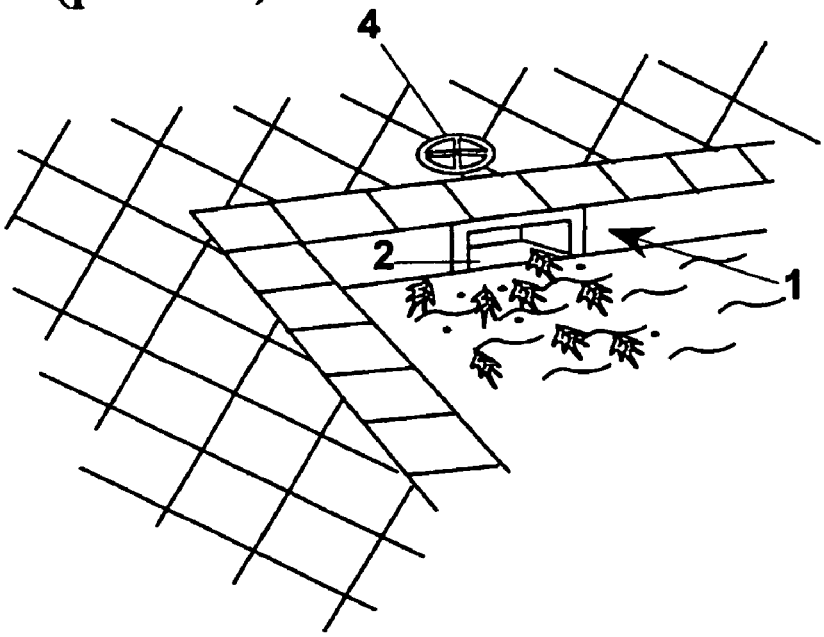
Fig. 1 (prior art)
FIGS. 1 and 2 show diagrammatically a skimmer of prior art used for removal of impurities from water surfaces.
Figure 2:
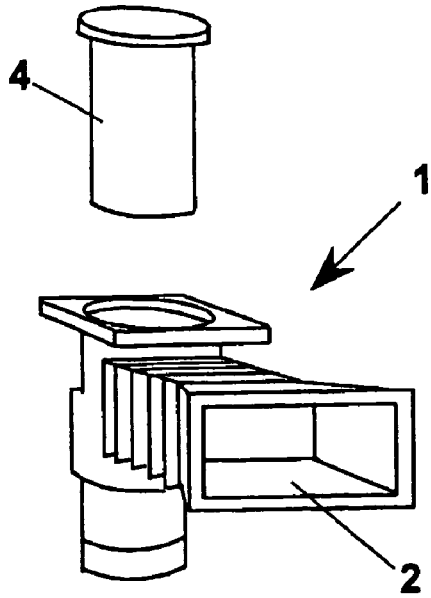
Fig. 2 (prior art)
Figure 3:
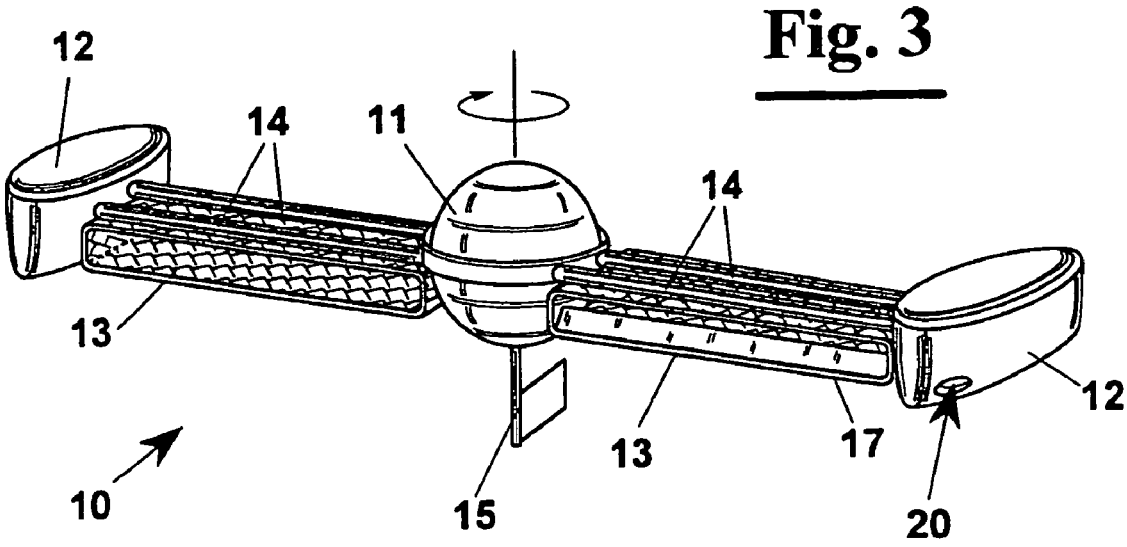
FIG. 3 shows in a perspective elevational front view the floating self-propelled cleaning device for water surfaces, according to a first exemplary embodiment of the invention.

With reference to FIG. 3 a first exemplary embodiment of a floating self-propelled cleaning device 10 for water surfaces, according to the invention, comprises a central floating body 11 and two side floating elements 12 to it connected at opposite sides. In particular, the two side floating elements 12 are connected to the central body 11 by connecting arms 14 to which two net-shaped collecting containers 13 are connected. Containers 13 can have one-way openings 17 that allow the inlet of impurities into containers 13 same, but block the outlet thereof during possible stops or under the action of waves that can occur during the travel on the water surface.

Figure 4:
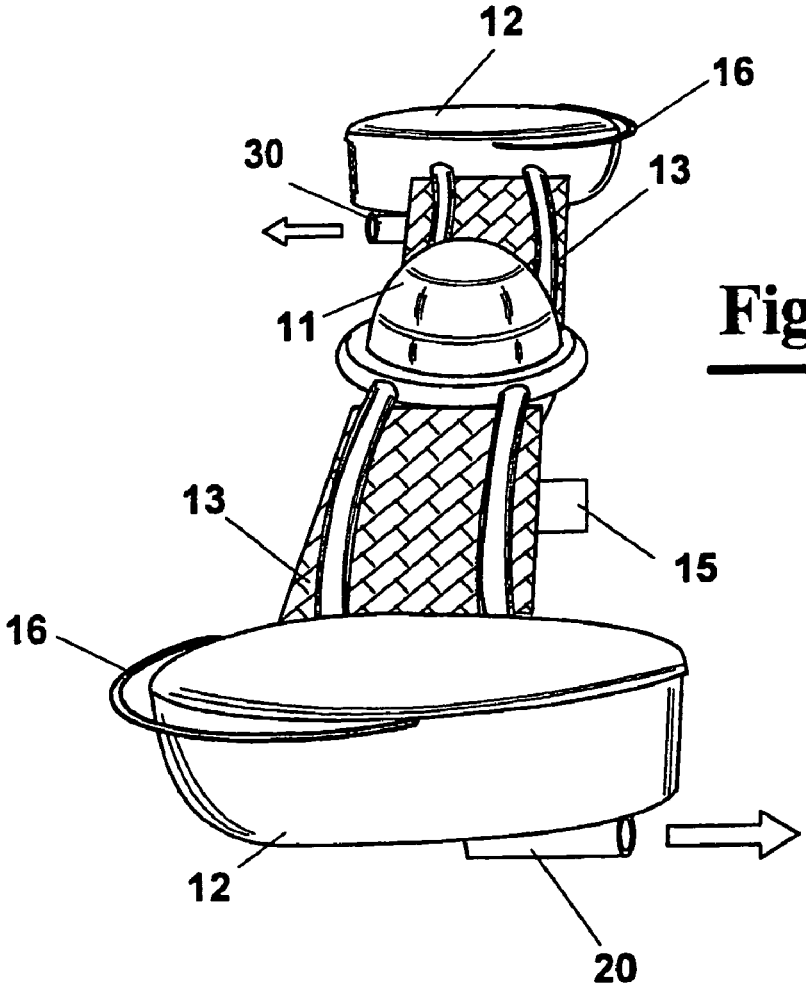
FIG. 4 shows a perspective elevational side view of an alternative exemplary embodiment of the device of FIG. 3.
Figure 5A:
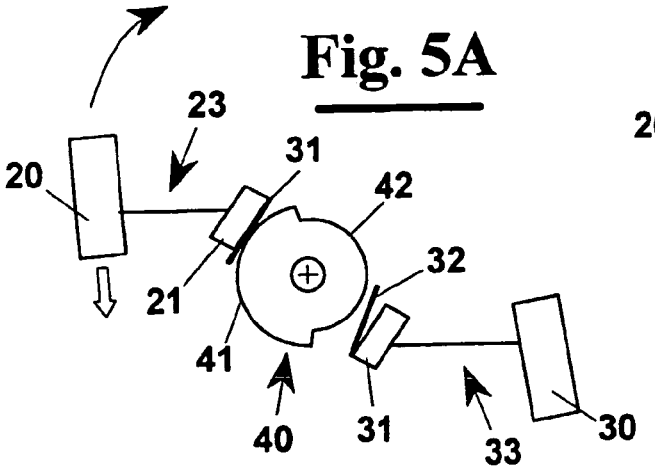
FIGS. 5A-5D show a possible diagrammatical scheme of operation of the propelling system of the device of FIGS. 3 and 4.
Figure 5B:
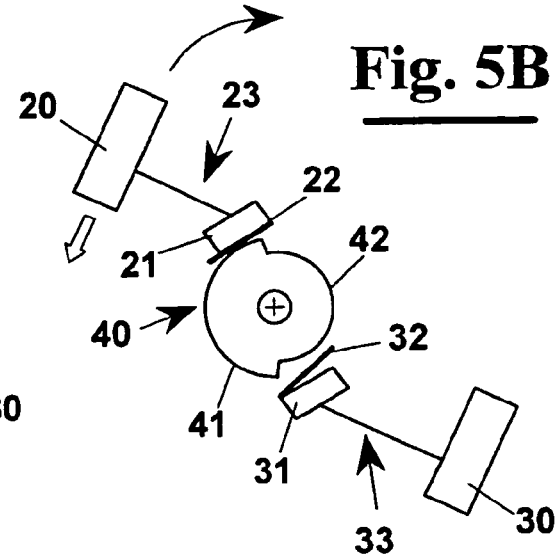
Figure 5C:
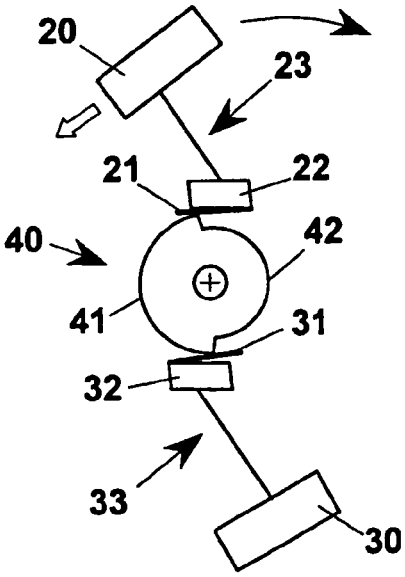
Figure 5D:
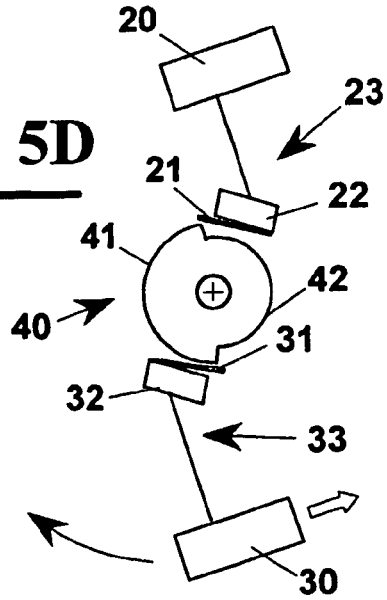
Figure 9:
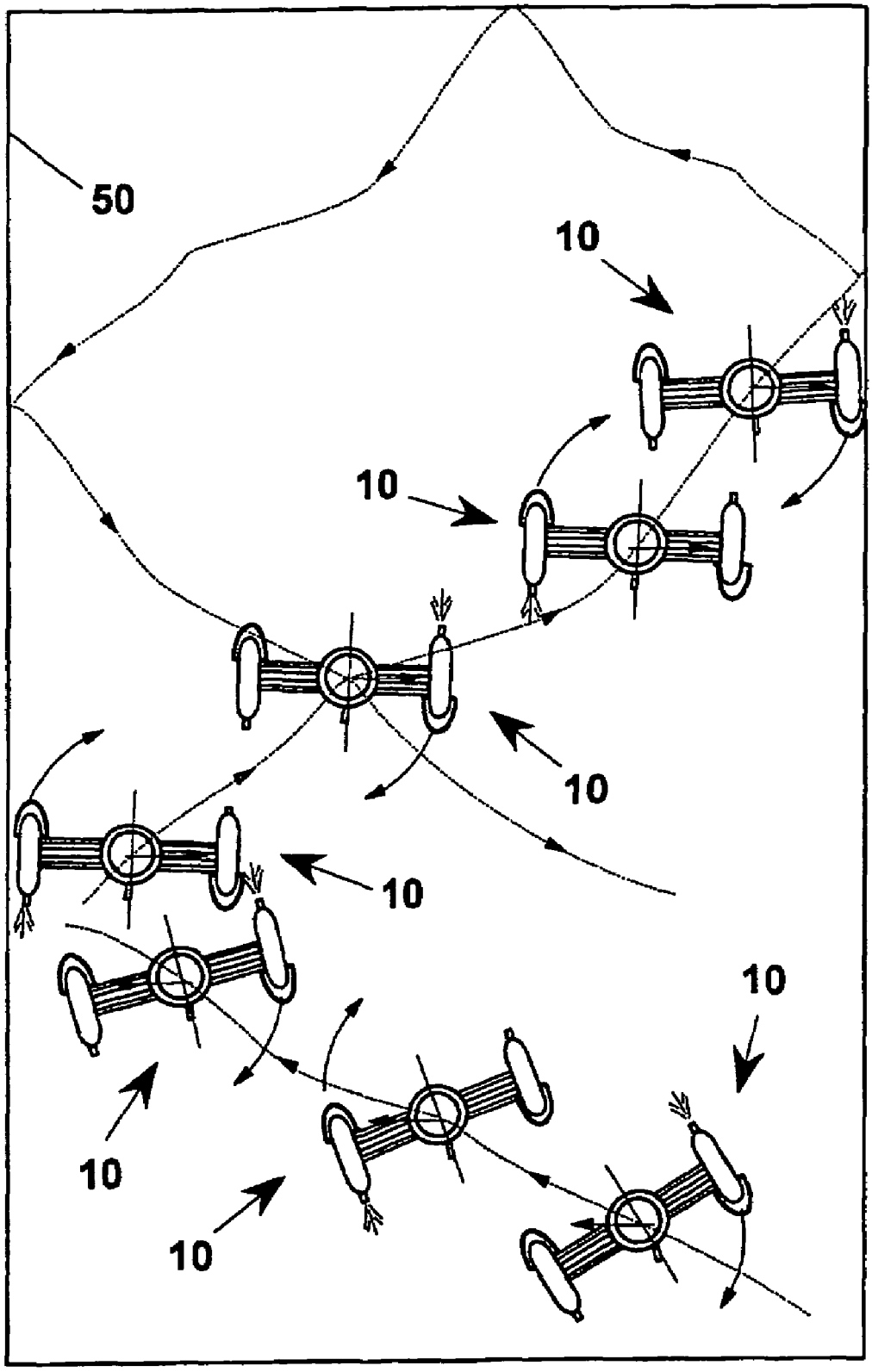
FIG. 9 shows diagrammatically a possible trajectory followed by the device, according to the invention, on a water surface.

In the case of FIGS. 3 and 4, the floating device 10 is driven by propelling means 20 and 30 that substantially cause the side floating elements 12 to rotate about an instantaneous centre of rotation located approximately at the central body 11. This rotation of the side floating elements 12 is associated to a shifting movement caused by at least a distribution element 15 movable with respect to the floating body 10. The sum of these two effects provides a resulting trajectory of the device 10 that causes the net-shaped containers 13 to sweep the whole water surface (FIG. 9).

These propelling means 20 for causing the rotation can be located within the floating elements 12 (FIG. 3) or outside them (FIG. 4). Alternatively, propelling means 120 can be connected outside central body 11 (FIG. 6) or can be housed inside it (not shown).

Figure 6:
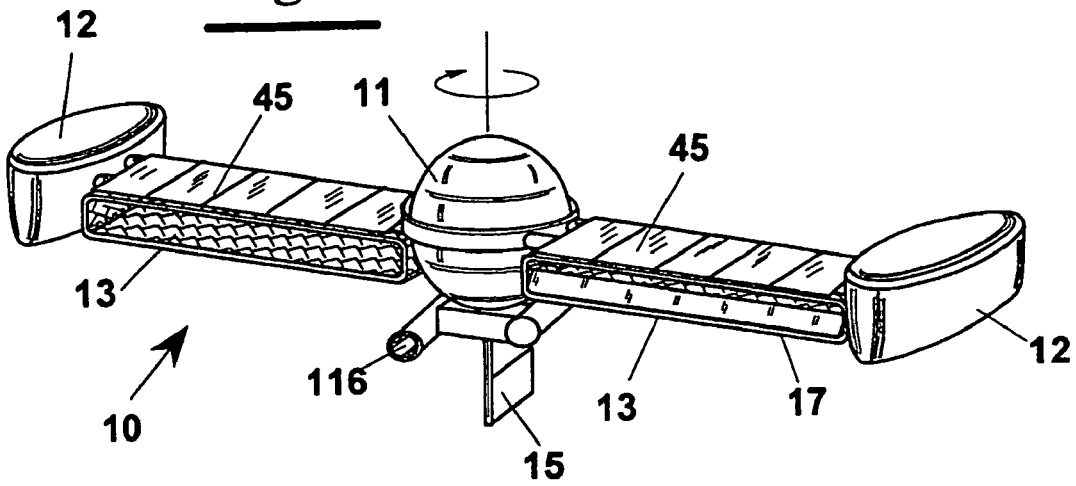
FIG. 6 shows in a perspective elevational front view a further alternative exemplary embodiment of the device of FIG. 3.

The energy for operating propelling means 20 or 120 is supplied, for example, by a battery (not shown) charged by solar panels 45 (FIG. 6).

Figure 8:
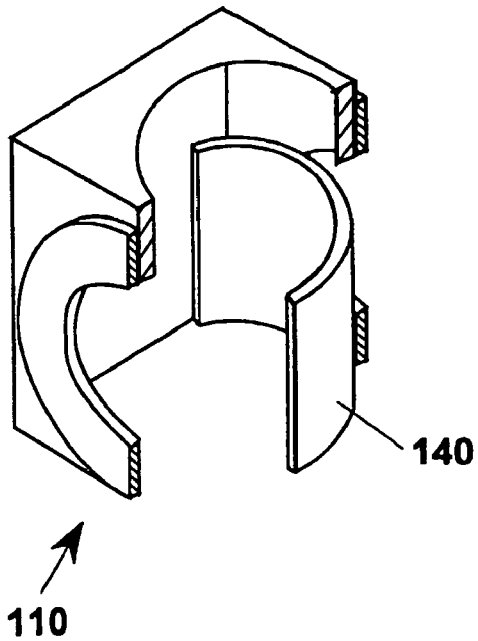

Advantageously, propelling means 20 generate alternately opposite thrusts that cause the rotation of the floating body 10. The alternation of the thrusts of the propelling means 20 is made by a distribution element 40 (FIG. 5A-5D) or 140 (FIG. 8) that distributes alternately the energy to each propelling means 20 or 30.

In particular, as diagrammatically shown in FIGS. 5A-5D, distribution element 40 can be a cam disk that operates alternately the propelling means 20, or 30 respectively, opening or closing the respective electric circuits 23, or 33, by means of switches 21, or 31.

In particular, cam disk 40 has a first portion 41 with larger outer diameter and a second portion 42 with smaller outer diameter. Therefore, during the rotation of the cleaning device 10 the propelling means 20 or 30 is operated whose switch 21, or 31, respectively, contacts the portion with higher diameter 41 of cam disk 40.

Figure 7:
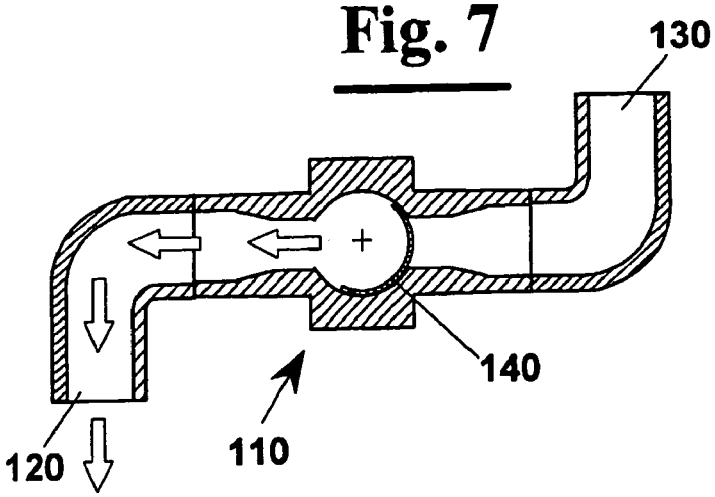
FIGS. 7 and 8 show respectively a cross sectional view and a partially cross sectioned perspective view of an exemplary embodiment alternative to the FIGS. 5A-5D of the propelling system of the floating self-propelled cleaning device.

Alternatively, the energy distribution means can comprise a two-way valve 110 (FIG. 7) having a deflector 140 that directs alternately, to two outlets 120 and 130 with apertures oriented in opposite directions, a water flow that generates the thrust necessary to cause the rotation of the floating device 10.

According to a further aspect of the invention, a feeler pawl 16 (FIG. 4) is provided that interrupts the delivery of energy to the corresponding propelling means 20 or 30 when the device 10 meets an obstacle, for example a sidewall 50 of the pool. This way, the self-propelled cleaning device 10 is capable of bouncing off the obstacle 50 and then of starting again to sweep the water surface according to a different trajectory.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

I claim:

1. A floating self-propelled cleaning device for water surfaces, comprising:

a) a floating body comprising a first and a second floating element;

b) at least one net-shaped collection container arranged between said floating element, said net-shaped collection container connected to said floating body and having an inlet;

c) a first and a second propelling means arranged respectively on said first and second floating elements suitable for generating opposite thrusts that cause the rotation of said floating body, so that the inlet of said container sweeps a portion of the water surface;

d) means for providing and switching energy alternately to each of the first and second propelling means so as to generate intermittent thrusts thereby causing a shifting movement to said floating body that serves, together with said rotation, to move the floating body horizontally on the water surface; and e) at least one electric energy source integrally associated with said floating body for providing and switching energy to said first and second propelling means, wherein said means for causing a shifting movement comprises a distribution element that distributes alternately the energy to each propelling means for generating intermittent thrusts, and wherein said distribution element distributes alternately the energy to each propelling means with the rotation of the floating body.

2. The device, according to claim 1, wherein said means for causing said floating body to rotate comprises at least one jet means suitable for generating a thrust that causes the rotation of said floating body about an instantaneous centre of rotation.

3. The device, according to claim 2, wherein said or each propelling means is in a position distanced from the centre of rotation.

4. The device, according to claim 1, wherein said floating body comprises a central body and said two side floating elements connected to said central body from opposite sides.

5. The device, according to claim 1, wherein said means for causing a shifting movement comprises at least a distribution element movable with respect to said floating body suitable for cooperating with said or each propelling means for generating intermittent thrusts.

6. The device, according to claim 1, wherein said means for causing a rotation comprises a first and a second propelling means arranged at said side floating elements and opposite to each other, said means for causing a rotation comprising two water jets forming a propelling couple with respect to said centre of rotation.

7. The device, according to claim 1, wherein said means for causing a shifting movement comprises at least a distribution element movable with respect to said floating body suitable for operating said or each propelling means for generating intermittent thrusts.

8. The device, according to claim 7, wherein said distribution element is a two-way valve arranged in a central chamber of a deflecting element that directs alternatively a water flow to two outlets having apertures oriented in opposite directions in order to generate a thrust in corresponding opposite directions.

9. The device, according to claim 1, wherein at least a feeler pawl is provided suitable for blocking the delivery of energy to a corresponding propelling means when the device meets an obstacle.

10. A floating self-propelled cleaning device for water surfaces comprising:

a) a floating body;

b) at least one net-shaped collecting container connected to said floating body and having an inlet;

c) a first and a second propelling means suitable for generating opposite thrusts that cause the rotation of said floating body so that the inlet of said container sweeps a portion of the water surface;

d) means for providing and switching energy alternately to each of the first and second propelling means so as to generate intermittent thrusts thereby causing a shifting movement to said floating body that serves, together with said rotation, to move the floating body horizontally on the water surface; and e) at least one energy source for said first and second propelling means, wherein said means for causing a shifting movement comprises at least one distribution element movable with respect to said floating body suitable for operating each propelling means for generating intermittent thrusts and wherein said distribution element comprises a blade disposed substantially under the water when in use and associated with a distribution element for alternately selecting each propelling means.

11. A floating self-propelled cleaning device for water surfaces comprising:

a) a floating body;

b) at least one net-shaped collecting container connected to said floating body and having an inlet;

c) a first and a second propelling means suitable for generating opposite thrusts that cause the rotation of said floating body so that the inlet of said container sweeps a portion of the water surface;

d) means for providing and switching energy alternately to each of the first and second propelling means so as to generate intermittent thrusts thereby causing a shifting movement to said floating body that serves, together with said rotation, to move the floating body horizontally on the water surface; and e) at least one energy source for said first and second propelling means, wherein said means for causing a shifting movement comprises at least one distribution element movable with respect to said floating body suitable for operating each propelling means for generating intermittent thrusts, wherein said distribution element comprises a blade disposed substantially under the water when in use and associated with a distribution element for alternately selecting each propelling means and wherein said distribution element is a cam disk that operates each propelling means alternately by a switch.

* * * * *